US005157705A

United States Patent [19]

Hohenauer

[11] Patent Number: 5,157,705

[45] Date of Patent: Oct. 20, 1992

[54] X-RAY TUBE ANODE WITH OXIDE COATING

[75] Inventor: Wolfgang Hohenauer, Kufstein, Austria

[73] Assignee: Schwarzkopf Technologies Corporation, New York, N.Y.

[21] Appl. No.: 591,624

[22] Filed: Oct. 2, 1990

[30] Foreign Application Priority Data

Oct. 2, 1989 [AT] Austria ..... 2276/89

[51] Int. Cl.[5] ..... H01J 35/08

[52] U.S. Cl. ..... 378/143; 378/127; 378/129

[58] Field of Search ..... 378/144, 129, 143, 128, 378/119, 125, 127

[56] References Cited

U.S. PATENT DOCUMENTS 3,993,923 11/1976 Magendans et al. ..... 378/129
4,516,255 5/1985 Peter et al. ..... 378/143
4,840,850 6/1989 Clark et al. ..... 428/471

FOREIGN PATENT DOCUMENTS 337316 10/1976 Austria .
0062380 6/1985 European Pat. Off. .
0177079 11/1988 European Pat. Off. .
2201979 8/1973 Fed. Rep. of Germany .
2443354 3/1975 Fed. Rep. of Germany .

*Primary Examiner*—David P. Porta
*Attorney, Agent, or Firm*—Morgan & Finnegan

[57] ABSTRACT

The invention relates to enhancing the thermal emissivity of metal X-ray tube anodes by means of applying an oxide coating to the anode. The oxide coating layer is formed of a mixture of zirconium oxide, titanium oxide, aluminum oxide and/or calcium oxide, with silicon oxide added from about 1–20% by weight of said oxide coating layer. Preferably, the coating includes from about 4–7% by weight of silicon oxide. The oxide coating layer is then applied to the anode pursuant to a standard method such as plasma spraying. The oxide coating, as formulated, displays improved layering characteristics over prior formulations while retaining good thermal emissivity and adhesive properties. Moreover, the formulation according to the invention enables an improved application to the anode of such oxides or oxide compounds over previous formulations, without negatively affecting the layer adhesion or thermal emission coefficient properties of the coating. Small quantities of other stabilizing oxide compounds may additionally be added to the oxide coating layer.

12 Claims, No Drawings

X-RAY TUBE ANODE WITH OXIDE COATING

FIELD OF THE INVENTION

This invention relates to an X-ray tube anode, in particular a rotating anode, of high thermal emissivity, with a base made of a refractory metal or its alloys, and a focal spot and/or focal path made of a refractory metal possibly different from that of the base, whereby the X-ray tube anode, at least on portions of its surface outside the focal spot, has an oxide coating essentially including the metals titanium, zirconium and optionally aluminum.

BACKGROUND

X-ray tube anodes emit just a fraction of the energy beamed into them in the form of X-ray radiation. The remainder is converted to heat and must exit the anode in the form of heat radiation.

For many years, the state of the art has been familiar with methods conceived to improve the thermal emissivity of X-ray tube anodes made of refractory metals by employing an oxide coating on the surface of the anodes (AT 337 314, DE-OS 22 01 979, DE-OS 24 24 43 354). These publications disclose various oxide materials and fabrication techniques, and lay claim to the ability to increase the adhesion of the oxide layer on the surface of the host metal vis-à-vis the state of the art and to raise the thermal emissivity of the anode surface.

It has been shown that the capacity of layers manufactured in accordance with such methods and techniques has not been able to keep pace with the increasing requirements for such products, in view of the ever increasing demands placed on X-ray tube anodes with respect to layer ageing, thermal reflectivity and resistance to degasification (prevention of electrical flashovers).

EU A2 0 172 491 discloses, in a further development, an X-ray tube anode, made of a molybdenum alloy, having an oxide coating consisting of a mixture of 40–70% titanium oxide, with the remainder of the coating comprising stabilizing oxides from the $ZrO_2$, HfO, MgO, $CeO_2$, $La_2O_3$, and SrO group. In order to better satisfy the previously mentioned demands placed on such layers, EU A2 172 491 proposes fusing the oxides so as to form smooth, glossy, gleaming layers.

EU A2 0 244 776 essentially pertains to the same subject matter. The publication relates to the preprocessing of the oxide material, prior to its application to the X-ray tube anode, by means of standard spraying techniques. Accordingly, in an initial processing step, a mixture consisting of 77–85% in weight of titanium oxide, with 15–23% in weight of calcium oxide, is processed to a powder mixture having a homogeneous phase. Thereafter, this mixture is applied to the X-ray anode (and, if necessary, in mixture with other oxide powders) in accordance with spraying methods known in the art. Plasma spraying, sputtering methods, chemical and physical precipitation processes from the gas phase, and electron beam methods are named as layering processes to be used in the application of an oxide coating to X-ray tube anodes made of refractory metals. Additionally, for X-ray tube anodes made of refractory metals, it is usual that the anodes undergo degasification annealing at the conclusion of the manufacturing process. The degasification annealing serves to prevent gas leakage from the anode, along with the resulting, highly undesirable, plasma flashovers between the electrodes when the anodes are used in an X-ray tube in a high vacuum.

The prior publication thus discloses a formulation of the oxide layer, with respect to annealing processing, following coating of the X-ray tube anodes. Degasification annealing simultaneously promotes final formation and fusing of the oxide phase, which is unachievable by an oxide application process alone. However, in view of the ever increasing demands placed on X-ray anodes, the composition and manufacturing processes for oxide layers disclosed in EU A2 244 776 are deficient. In fact, the annealing process disclosed in this prior printed publication presents the danger of an unacceptable degree of interfusion of the oxide layer, in the area of the focal path, at the border between the coated and uncoated portions of the surface of the X-ray tube anode. This occurs because the annealing temperature required to fuse the oxides into smooth, satisfactorily adherent layers renders the layers highly fluid.

In addition, such oxide layerings exhibit an unwelcome gas phase formation at the requisite annealing temperatures.

SUMMARY OF THE INVENTION

The task of the present invention, therefore, consists in formulating a composition for an oxide surface layer that continues to retain or exceed the thermal emmissivity characteristics of the oxide layer of previously known formulations. Additionally, the adhesive properties heretofore achievable between the oxide layer and its substratum pursuant to standard application processes are also retained or exceeded. However, the structural design and composition of the oxide layer according to the invention is such that the manufacture of the layer is facilitated, particularly with respect to smooth fusion of the layers, without unwelcome vaporization or undesirable flow of the oxide layer during annealing processing of the anode.

DETAILED DESCRIPTION OF THE PREFERRED EMBODIMENTS

In accordance with the present invention, the aforesaid task is solved in that the oxide coating contains silicon oxide from about 1–20% by weight of the coating. Moreover, the coating is applied to the X-ray tube anode in a homogeneously fused phase.

In accordance with the invention, the oxide layer applied to an X-ray tube anode made of refractory metals exhibits excellent adhesion characteristics, smooth surfaces, and a high thermal heat coefficient of $E \approx 0.80$. The oxide layer has the decisive advantage, vis-à-vis the state of the art, of decreased fluidity under otherwise comparable conditions during the required annealing processing of the anode; that is, during annealing processing, the fusing viscosity of the oxide layer manufactured according to the invention is higher, compared to similar prior art formulations not containing the silicon oxide adhesive. Thus, the borders between surface parts with and without the oxide coating do not interfuse. Vaporization of the layer occurs to a comparably minor extent only, as does the undesired precipitation of oxide components onto non-coated surface parts during annealing. By coordinating the annealing temperature with the oxide composition, oxide layers having a desired surface roughness of approximately 20 $\mu m$ ($R_T$) and having the texture and appearance of an "orange-skin" can be achieved.

Today, X-ray anodes are usually made from refractory metals such as tungsten, molybdenum or molybdenum alloys, and in particular from the carbonaceous TZM alloy. In accordance with the invention, silicon oxide is added to the oxide coating from about 1–20% by weight of the layer. Preferably, however, silicon oxide constitutes 4–7% of the weight of the layer.

The remainder of the oxide coating may exhibit, for example, the oxide components zirconium oxide, calcium oxide and titanium oxide in a ratio of 70:10:20 by weight. Other stabilizing oxides known in the art may supplement or entirely substitute calcium oxide depending on the desired application; similarly, the layer may be additionally supplemented by small parts of other, thermally stable compounds like borides and/or nitrides. The aforementioned stabilizing oxide compound may contain up to 10% by weight of aluminum oxide components, primarily to reduce or regulate fusion temperature.

Depending on the method of precipitation, the thickness of the oxide layer can vary between a few and several thousand micrometers. The oxide layer may be applied with known precipitation processes such as PVD and CVD processes, especially plasma CVD methods and sputtering processes. These processes have shown themselves just as expedient as flame-spraying, plasma-spraying, and electron beam methods.

With respect to the oxide coating, a homogeneous phase shall be understood to mean a finely distributed oxide compound.

For X-ray tube anodes of molybdenum and standard molybdenum alloys, like TZM, the desired oxide layer structure and surface roughness can be achieved by means of repeated annealing at temperatures between 1550° C. and 1680° C. and during an annealing period lasting from 30 minutes to 1½ hours. The layer so applied continues to display good adhesive characteristics with the host material. However, it has been observed that vaporization of oxide components begins at temperatures in excess of approximately 1550° C. Therefore, it is recommended to cover the focal path (focal spot) during the annealing processing. Alternatively, one may subject the focal path to a final cleaning (for example, a grinding treatment) subsequent to annealing processing.

Alternatively, of course, it is understood that for other embodiments of the X-ray tube anode according to the invention, it may be desired that the focal spot also be coated with the oxide coating layer.

TZM molybdenum alloy, which contains small parts of carbon, tends to release carbon at temperatures in excess of 1550° C. The released carbon tends to combine with the oxygen components of the oxide so as to form volatile CO or $CO_2$. This may detrimentally cause premature ageing and deterioration of the oxide layer. Therefore, when using TZM as the host material, it is advantageous to insert a diffusion barrier between the host material and oxide layer. This diffusion barrier may comprise, for example, a layer of pure molybdenum, or it may be formed in a multi-strata combination of molybdenum and oxide composite material. The thickness of the diffusion barrier may vary from a few micrometers up to the millimeter range.

The invention will now be further illustrated by way of the following examples.

EXAMPLE 1

A rotating X-ray tube anode, formed of a molybdenum alloy with 5% by weight tungsten, exhibits an W-Re layer, approximately 2-mm-thick, in the focal path. To increase thermal reflectivity, the anode surface is coated with an oxide layer in accordance with the invention.

Prior to coating, the backside of a ready-sintered and mechanically converted X-ray tube anode is cleaned and roughened by means of sand blasting. As soon as thereafter possible, the backside of the anode is coated with an oxide powder by means of the plasma-spraying. The oxide powder exhibits the following composition: 89% by weight of an oxide mixture consisting of 72% by weight of $ZrO_2$, 8% by weight of CaO, and 20% by weight of $TiO_2$; further, the remainder of the powder consists of 5% by weight of $Al_2O_3$ and 6% by weight of $Si\text{-}O_2$.

The coated anode must then undergo annealing processing to render it fit for use in X-ray tubes. Annealing in this manner frees the rotating anode as a whole, and specifically the host material and the layering material, of potentially deleterious gas pockets. Additionally, at higher annealing temperatures, volatile impurities are also expelled, thereby precluding flashovers that result from the release of gas pockets when the rotating anode is used a high-vacuum X-ray tube.

The degasification annealing, correlated according to the host material of the anode, is preferably effected within a very narrow temperature range and time domain so as to prevent undesired structural modification of the host material. However, according to composition, the oxide layer must be annealed within a very specific temperature range and time domain in order that the layer will fuse in the desired homogeneous phase, and so that the oxide layer will display a slightly raised surface structure (e.g., an "orange-skin" type layer).

In the present example, annealing was effected at 1620° C. for a period of 65 minutes. The fused layer exhibits both the desired degree of blackening and the desired surface structure ("orange-skin" texture). No uncontrolled interfusing of the fusing oxide layer occurs, especially not in the transition region between coated and uncoated surface portions of the rotating anode. Although gaseous oxides are vaporized during the annealing process, they do not precipitate as an unwelcome coating on the originally uncoated focal path of the rotating anode.

The rotating anode was subsequently tested in an X-ray tube testing array under practical operating conditions. There, it functioned over the course of several days within required critical loads without incident or interruption.

EXAMPLE 2

A rotating X-ray tube anode, made of the TZM alloy, exhibits an W-Re layer, approximately 2-mm-thick, in the focal path. To increase thermal reflectivity, the anode surface is provided with an oxide layer in accordance with the invention.

A ready-sintered and mechanically converted X-ray tube anode is cleaned and roughened by means of sand blasting and, as soon thereafter as possible, is coated by means of plasma-spraying (or other standard procedural methods) outside the focal path. A two-strata diffusion layer is first applied. A molybdenum strata layer, functioning as a carbon barrier, is applied and subjected to reduction annealing in hydrogen at 1350° C. for a period in excess of 2 hours. Thereafter, a second strata, essentially consisting of an initial oxide coating of aluminum oxide-titanium oxide host material, is applied to the anode. This initial oxide layer allows the final oxide coating (which is prone to blackening) to fuse to an acceptable degree. The final oxide coating exhibits the following composition: 94% by weight of an oxide compound consisting of 72% by weight zirconium oxide, 8% by weight calcium oxide, and 20% by weight titanium oxide; and 6% by weight of silicon oxide.

The coated rotating anode manner must then undergo annealing processing as explained in Example 1.

Annealing conditions are: T=1580° C., h=45 min.

As in Example 1, the rotating anode was subsequently tested in an X-ray testing array under practical operating conditions. There, it functioned within the required critical loads without incident or interruption.

It will be apparent that other and further forms of the invention may be devised without departing from the spirit and scope of the appended claims, it being understood that this invention is not limited to the specific embodiments shown.

What is claimed is:

1. A thermally emissive X-ray anode, comprising:

a base portion of a refractory metal or alloys thereof;

a focal spot for emitting X-ray radiation, said focal spot made of a refractory metal;

an oxide coating layer outside said focal spot for improving the thermal emissivity of said anode, said oxide coating layer consisting essentially of a homogeneously fused phase of titanium oxide and zirconium oxide; and an additive component for improving said homogeneously fused phase of said oxide coating layer, said additive component consisting of silicon oxide from about 1 to 20% by weight of said oxide coating layer.

2. The X-ray anode of claim 1, wherein said additive component comprises silicon oxide from about 4–7% by weight of said oxide coating layer.

3. The X-ray anode of claim 1, wherein said oxide coating layer further comprises an additional oxide additive for stabilizing the homogenously fused phase of said oxide coating layer.

4. The X-ray anode of claim 3, wherein said additional oxide additive comprises CaO.

5. The X-ray anode of claim 1, wherein said oxide coating layer is extended to said focal spot.

6. The thermally emissive X-ray anode of claim 1, wherein said oxide coating layer further consisting essentially of aluminum oxide.

7. A thermally emissive X-ray anode, comprising:

a base portion made of a molybdenum alloy;

a focal spot for emitting X-ray radiation, said focal spot made of a refractory metal;

an oxide coating layer on said base portion for improving the thermal emissivity of said anode, said oxide coating layer comprising a homogeneously fused phase of titanium oxide and zirconium oxide;

an additive component for improving the homogeneously fused phase of said oxide coating layer, said additive comprising silicon oxide from about 1 to 20% by weight of said oxide coating layer; and an intermediate diffusion layer, having a first strata comprising molybdenum and a second strata comprising $TiO_2$ or $Al_2O_3$ or combinations thereof, for preventing deterioration of said oxide coating layer, said intermediate layer having a thickness from about 10 to 1000 μm and sandwiched between said anode and said oxide coating layer.

8. The X-ray anode of claim 7, wherein said oxide coating layer further comprises an additional oxide additive for stabilizing the homogeneously fused phase of said oxide coating layer.

9. The X-ray anode of claim 8, wherein said additional oxide additive comprises CaO.

10. The thermally emissive X-ray anode of claim 7, wherein said oxide coating layer further comprises aluminum oxide.

11. A thermally emissive X-ray anode, comprising:

a base portion made of a refractory metal;

a focal spot for emitting X-ray radiation, said focal spot made of a refractory metal; and an oxide coating layer outside said focal spot for improving the thermal emissivity of said anode, said oxide coating layer consisting essentially of:

an oxide mixture from about 89% by weight of said oxide coating layer, said oxide mixture consisting of about 72% $ZrO_2$ by weight, 8% CaO by weight, and 20% $TiO_2$ by weight;

$Al_2O_3$ from about 5% by weight of said oxide coating layer; and $SiO_2$ from about 6% by weight of said oxide coating layer.

12. A thermally emissive X-ray anode, comprising:

a base portion made of a molybdenum alloy;

an oxide coating layer outside said focal spot for improving the thermal emissivity of said anode, said oxide coating layer comprising an oxide mixture from about 89% by weight of said oxide coating layer, said oxide mixture consisting of about 72% $ZrO_2$ by weight, 8% CaO by weight, and 20% $TiO_2$ by weight;

$Al_2O_3$ from about 5% by weight of said oxide coating layer; and $SiO_2$ from about 6% by weight of said oxide coating layer, wherein said anode further comprises an intermediate diffusion layer, having a first strata comprising molybdenum and a second strata comprising $TiO_2$ or $Al_2O_3$ or combinations thereof, for preventing deterioration of said oxide coating layer, said intermediate layer having a thickness from about 10 to 1000 μm and sandwiched between said anode and said oxide coating layer.

* * * * *